United States Patent [19]

Dingfelder

[11] Patent Number: 4,502,343

[45] Date of Patent: Mar. 5, 1985

[54] PUMP JACK

[76] Inventor: Alan W. Dingfelder, 10299 W. Main Rd., North East, Pa. 16428

[21] Appl. No.: 250,100

[22] Filed: Apr. 2, 1981

Related U.S. Application Data

[63] Continuation-in-part of Ser. No. 183,889, Sep. 4, 1980, abandoned.

[51] Int. Cl.[3] ..... F04B 47/02

[52] U.S. Cl. ..... 74/41; 74/411

[58] Field of Search ..... 74/41, 411, 586

[56] References Cited

U.S. PATENT DOCUMENTS

| | | | |
|---|---|---|---|
| 495,852 | 4/1893 | Thayer . | |
| 735,518 | 8/1903 | Hussey . | |
| 1,048,632 | 12/1912 | Zierath . | |
| 1,298,424 | 3/1919 | Warrener | 74/586 |
| 1,414,876 | 5/1922 | Hoffman . | |
| 1,592,391 | 7/1926 | Stevenson . | |
| 1,751,767 | 3/1930 | Sperry . | |
| 1,784,003 | 12/1930 | Franks | 74/586 |
| 1,848,039 | 3/1932 | Zimmermann . | |
| 1,908,653 | 5/1931 | Andrews . | |
| 1,992,393 | 2/1935 | Rawson . | |
| 2,005,122 | 6/1935 | Young et al. | 74/41 |
| 2,046,275 | 6/1936 | Mahan | 74/41 |
| 2,057,137 | 10/1936 | Culbertson | 74/41 |
| 2,057,917 | 10/1936 | Ratigan . | |
| 2,071,437 | 2/1937 | Searle | 74/41 |
| 2,117,716 | 5/1936 | Gordy, Jr. . | |
| 2,148,516 | 2/1937 | Thompson . | |
| 2,265,379 | 12/1939 | Lyne . | |
| 2,271,594 | 2/1942 | Kanalz . | |
| 2,274,601 | 2/1939 | Hartgering et al. . | |
| 2,308,823 | 1/1941 | Phipps . | |
| 2,488,124 | 11/1946 | Hawley, Jr. et al. . | |
| 2,526,651 | 10/1945 | Garbo . | |
| 2,556,259 | 6/1951 | Dorris et al. | 74/411 |
| 2,818,953 | 1/1958 | Hall et al. | 74/411 |
| 2,997,887 | 8/1961 | Lott . | |
| 3,006,201 | 10/1957 | Ross . | |
| 3,029,650 | 4/1958 | Byrd . | |
| 3,146,629 | 9/1964 | Schmitter | 74/411 |
| 3,230,782 | 1/1966 | Harryman et al. . | |
| 3,371,554 | 3/1968 | McCray et al. | 74/41 |
| 3,405,605 | 10/1966 | Ross . | |

OTHER PUBLICATIONS

Standard Products Catalogue of Morse Division of Borg-Warner, SP80, 1981, pp. F-14 and F-15.

*Primary Examiner*—Lawrence J. Staab
*Attorney, Agent, or Firm*—Parkhurst & Oliff

[57] ABSTRACT

A pump jack having a resiliently mounted speed reducer. The pump jack comprises a frame, a sampson post, and a walking beam pivotally mounted on the sampson post. Crank shaft bearings are securely mounted on the sampson post. A speed reducer is resiliently mounted to the sampson post and coupled to the crank shaft extending through the crank shaft bearings. Thus, non-torsional forces are transferred to the sampson post, reducing wear on the speed reducer and obviating the necessity of a speed reducer of large size. This results in decreased power necessary to run the pump jack. This also allows the use of a single pitman rod configuration, which is subject to less wear than previous double pitman configurations.

2 Claims, 6 Drawing Figures

FIG. 1
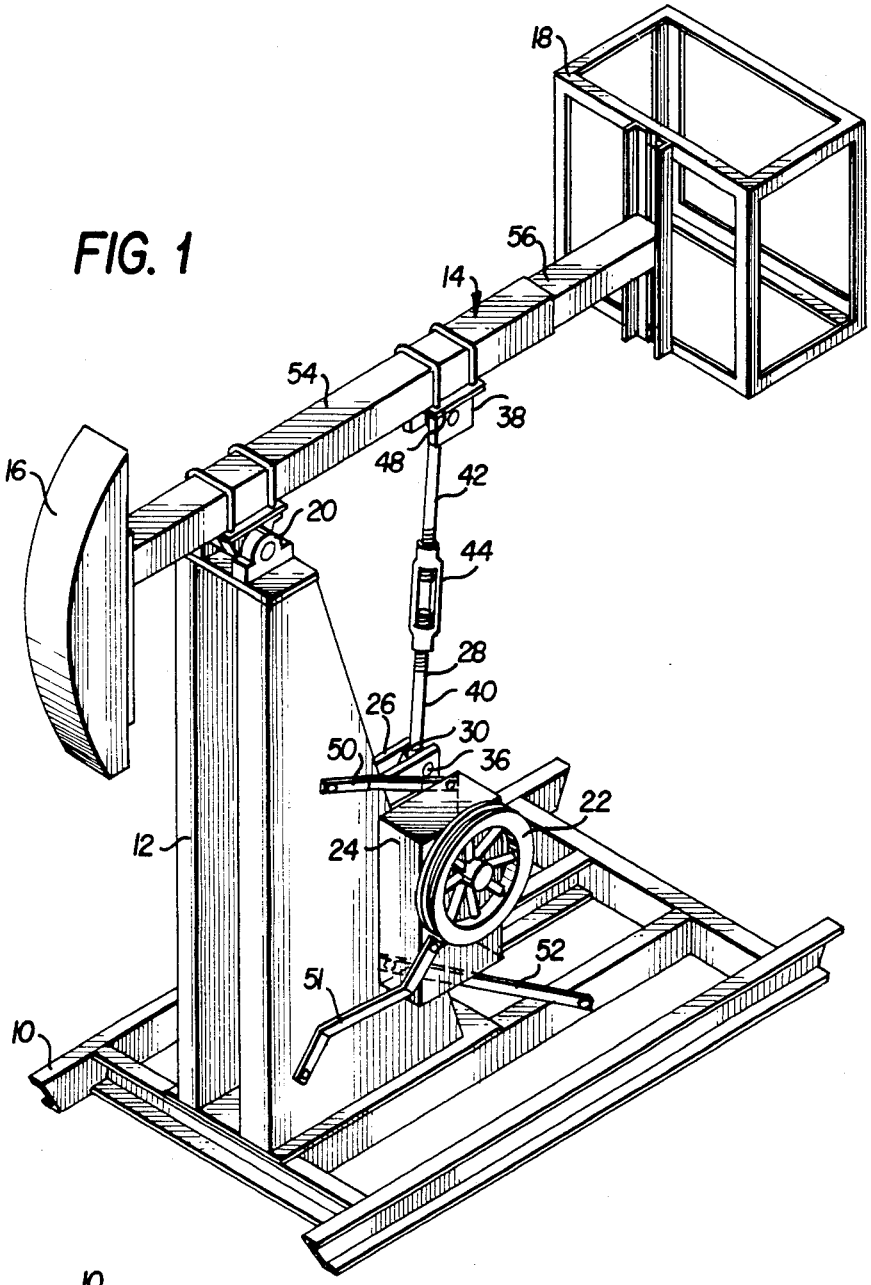
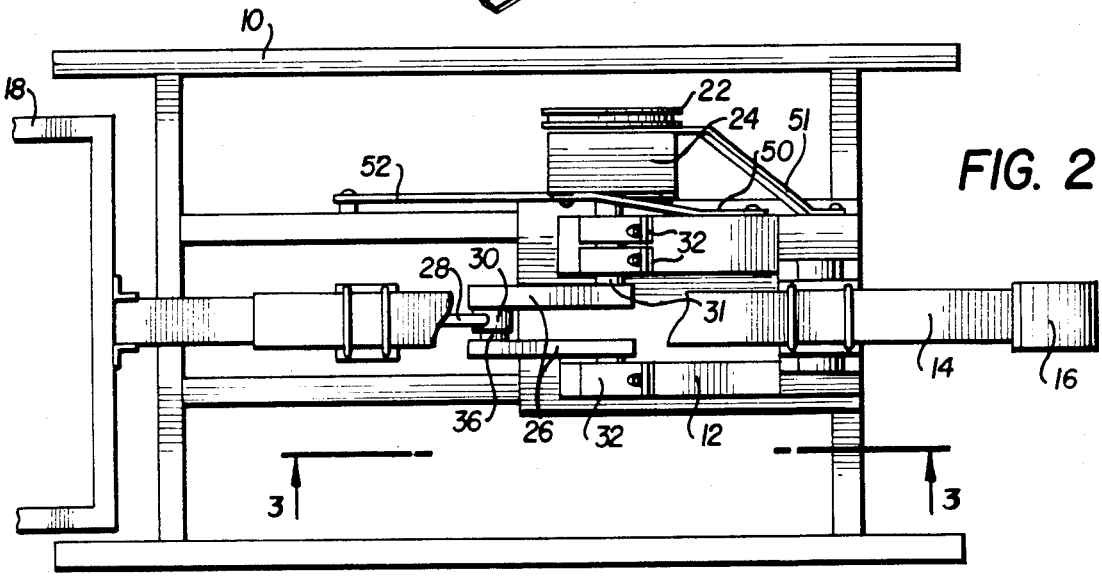
FIG. 2

PUMP JACK

CROSS REFERENCE TO RELATED APPLICATIONS

This application is a continuation-in-part of U.S. Application Ser. No. 183,889, filed Sept. 4, 1980 now abandoned.

BACKGROUND OF THE INVENTION

1. Field of the Invention

This invention relates to pump jacks, and more particularly to a pump jack capable of using a speed reducer of relatively small size.

2. Description of the Prior Art

Pump jacks are used in pumping underground liquids up to the surface. Pump jacks convert the circular motion of a motor into the reciprocal motion of a well rod. The well rod is the pump which extends underground down through the well head.

Previous pump jacks generally comprise in part a double pitman rod which is connected to a speed reducer through a crank. At the top and bottom of the stroke of the walking beam, the pitman rod is directly over the center of rotation of the cranks. Due to this alignment between the pitman rod and the center of rotation of the crank, the motion of the walking beam is such that there is a sudden jerk as the walking beam reaches the top and bottom of its stroke and reverses direction. This jerking results in great forces in the pitman rod and in the crank center shaft.

Since the crank center shaft is solely supported by the speed reducer, all the forces transferred from the pitman rod into the crank are also transferred into the speed reducer. Because of these large non-torsional forces the speed reducer is required to absorb during the motion of the walking beam, the speed reducer has to be relatively large and has a tendency to break down frequently. The relatively large speed reducers require a great deal of power to overcome their frictional losses and their internal inertial forces. These previous pump jacks require such large speed reducers that a large portion of the power requirement of the pump jack is that due to the friction and inertia inside the speed reducer.

SUMMARY OF THE INVENTION

It is an object of this invention to provide a pump jack whose reciprocating movement is improved.

Another object of this invention is to provide an improved pump jack whose stroke has a higher initial deceleration at the beginning of the up-stroke of the pitman rod than the acceleration at the end of its down-stroke.

Another object of the invention is an improved pump jack whose speed reducer unit is resiliently mounted to the pump jack such that the speed reducer is subject to minimal non-torsional forces.

Another object of the invention is to provide an improved pump jack which uses a proportionally smaller speed reducer and has smoother reciprocating movement than previous pump jacks.

Another object of the invention is to provide an improved pump jack that is simple in construction, economical to manufacture, and simple and efficient to use.

With the above and other objects in view, the present invention comprises the combination and arrangement of parts hereinafter more fully described, illustrated in the accompanying drawings and more particularly pointed out in the appended claims, it being understood that changes may be made in form, size, proportions and minor details of construction without departing from the invention.

DESCRIPTION OF THE DRAWINGS

FIG. 1 is a top-side perspective view of the pump jack;

FIG. 2 is top, partially cut away, view of the pump jack;

DETAILED DESCRIPTION OF THE DRAWINGS

Figure 3:
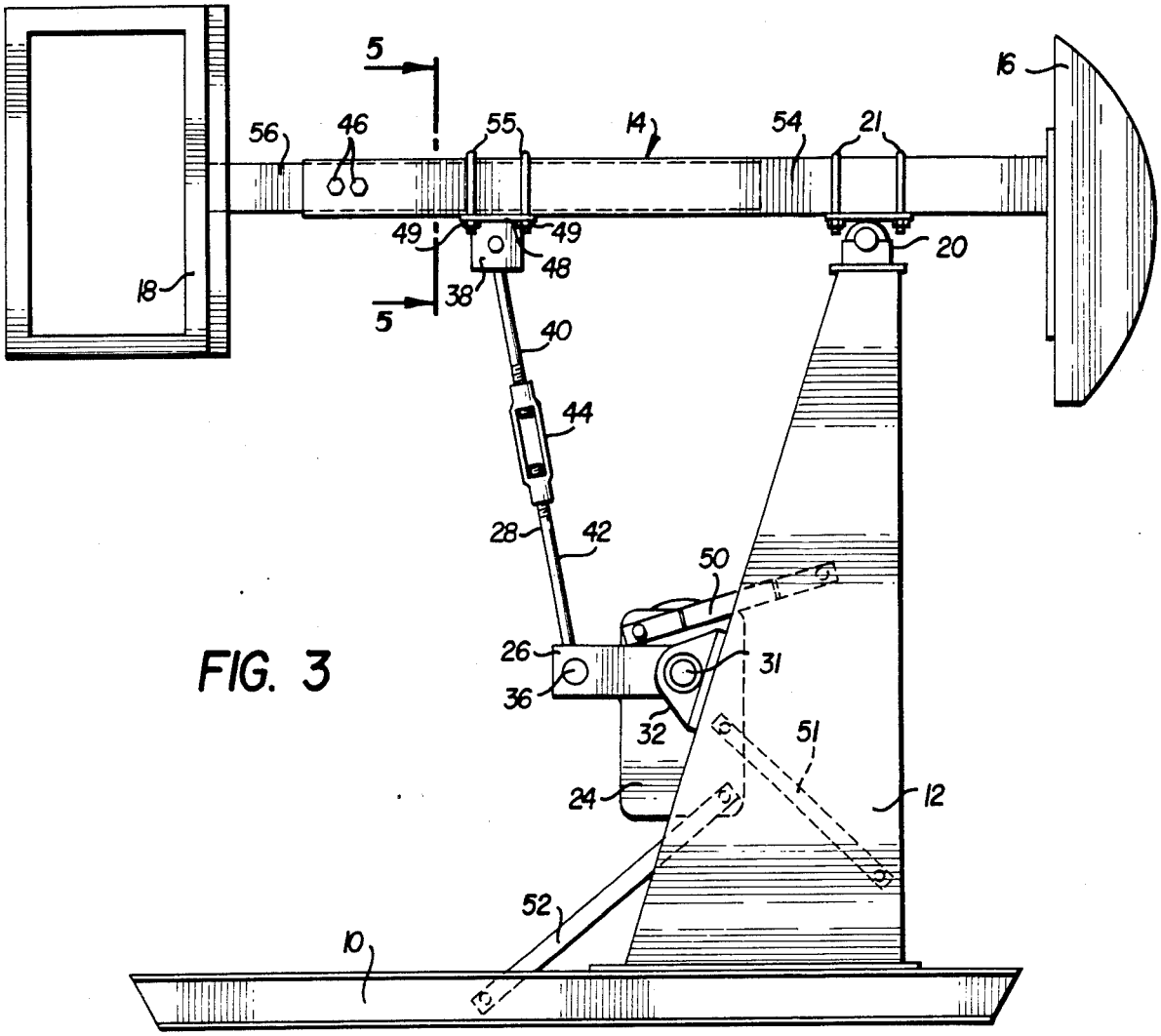
FIG. 3 is a side view of the pump jack.
Figure 4:
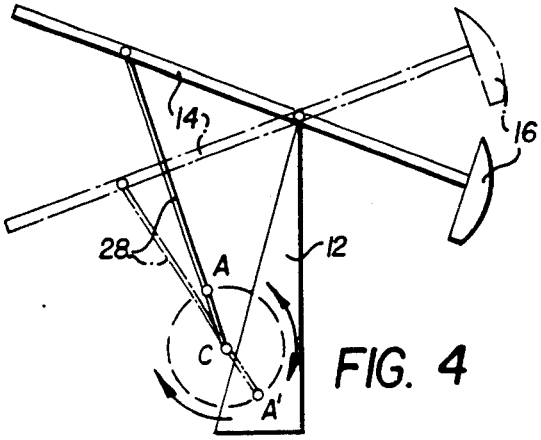
FIG. 4 is a schematic drawing of the motion of the pump jack.

Now, with more particular reference to the drawings, the pump jack's main structural parts comprise a frame 10, a sampson post 12 supported by and extending upwards from the frame, and a walking beam 14 pivotably supported on the top of the sampson post. The walking beam has at one end a horse's head 16 which is the means by which the well rod is connected to the pump jack. At the other end of the walking beam is a counterbalance to the horse's head and well rod, which in this embodiment is shown as a carriage 18. The mass of the carriage is variable such that the center of gravity of the walking beam, horse's head, well rod, and carriage is substantially at the sampson pivot point 20. Thus, the walking beam is nearly balanced about the pivot point. The walking beam may be secured to the sampson pivot by means of a threaded U-shaped clamp and lock nut assembly 21.

The reciprocating motion of the walking beam is generated from the rotating motion of a motor (not shown). The assembly of the pulley 22, speed reducer 24, crank 26, and pitman rod 28 converts the rotating motion into the reciprocating motion of the walking beam 14. At the heart of this assembly is the crank 26 whose motion is that of a radial arm rotating about a center at one end of the arm while being rotatably connected to the pitman rod at the other end of the crank. The pitman rod 28 is preferably connected to crank 26 by means of a shock absorbing, self aligning ball bearing 30. The pitman rod extends up to the walking beam where it is pivotally connected thereto. The pitman rod is long enough such that the circular motion that the end of the pitman rod connected to the crank follows does not interfere with the reciprocating motion that the end connected to the walking beam follows. The pitman rod is also preferably provided with a turnbuckle 44 to allow provision of a variable pitman rod length. It should be noted that the present invention also allows the use of a single pitman rod. Past pump jacks have been comprised of double pitman structures. Besides the obvious saving of material, this single pitman arrangement has been found to provide better wear characteristics than prior art devices, whose double pitman structure exacerbated the effect of any wear.

Coaxial with the circle through which the crank rotates is the crank center shaft 31 onto which the crank is affixed. One end of the crank center shaft is connected to the output of the speed reducer. The crank center shaft 31 is rotatably supported on the sampson post, preferably with self aligning pillow block bearings 32, such that substantially all the forces of the crank, except the movements about the axis of the crank center shaft, are absorbed into the sampson post. None of the non-torsional forces are transferred to the resiliently mounted speed reducer. The pillow block bearings 32 can be bolted onto the sampson post, which can be provided with a plurality of holes to allow variable height settings. The speed reducer 24 is preferably a shaft mounted gear box having a hollow shaft (not shown) keyed over the crank shaft 31, such as the Fort Worth Model 115 SM 25 gear box, using a 1 and 15/16 inch bore shaft mount and a 25:1 gearing ratio. The speed reducer is also laterally offset with respect to walking beam 14.

Connected to the input of the speed reducer is a pulley 22 around which either a belt or chain drive from a motor (not shown) can be used to power the pump jack.

More particularly, the embodiment disclosed in the drawings shows a sampson post composed of two parallel legs between which exists a small gap. On the edge of these sampson post are mounted three crank bearing mounts (pillow block bearings 32) housing three crank bearings, one crank bearing mount being on one leg of the sampson post and two crank bearing mounts mounted on the other leg. The crank bearing mounts could also be mounted on support braces for the sampson post, if these braces are present. Through the crank bearings extends the crank center shaft 31, which is perpendicular to the walking beam. The crank center shaft extends outwardly from the pair crank bearings mounted on the same sampson post leg into the output of the speed reducer 24. The other end of the crank center shaft is supported by the crank bearing singularly on the sampson post leg. Bridging the gap between the sampson post legs is the crank. The crank comprises two parallel arms which are connected together at one end by a shaft 36 and are connected at their other ends to the crank center shaft. The crank center shaft 31 is preferably press fitted and molded to crank 26. There is no crank center shaft between the two radial arnms of the crank.

The pitman rod 28 is rotatably connected by way of a bearing (self aligning ball bearing 30) to the shaft 36 connecting and in between the two radial arms of the crank. Shaft 36 is preferably press or force fitted into the ends of the crank arms. The pitman rod extends upwards to the walking beam at which it is rotatably connected to the pitman pivot 38. The pitman pivot is preferably mounted on another self aligning ball bearing 39. The pivot is mounted on walking beam 14, as will be later described, and can be moved relative thereto (but is fixed during operation of the pump jack). Walking beam 14 is pivoted to sampson post 12 at a fixed pivot point 20, providing a fixed axis of rotation at that point. The gap between the two radial arms of the crank must be wide enough to allow the pitman rod to freely pass through as the crank rotates. The circular motion of the end of the pitman rod connected to the crank is converted into reciprocal motion at the end of the pitman rod connected to the pitman pivot and since the pitman pivot is affixed to the walking beam, the reciprocal motion of the pitman rod is that which drives the walking beam.

The geometry of the crank center shaft crank, pitman rod, pitman pivot, walking beam, and sampson post governs the reciprocal motion of the walking beam for a given RPM of the crank. The motion of the walking beam is important as to the length of the pump stroke, and more importantly to the present invention, to the smoothness of the operation of the pump jack.

The applicant has found that by positioning the pitman pivot such that it is further away from sampson pivot along the walking beam then would be the pitman pivot if it was in vertical alignment with the crank center shaft, causes the motion of the walking beam to be much smoother, especially at the top and bottom of the stroke. The motion of the pump jack, shown in FIG. 2, is such that, at a constant rotational speed of the crank, the time required for the horse head to complete its upstroke is shorter than that required to complete a downstroke. This is a result of the angle through which the crank must pass during the up and down stroke. The angle through which the crank must pass during the horse's head's downstroke, angle (A'CA) is larger than the angle (ACA') that the crank passes through while the horse head completes its upstroke. Thus, since the crank is operating at a constant speed, it is implicit that the time required for the crank to pass through a larger angle is greater than the time required for the crank to pass through a smaller angle.

Since the upstroke of the walking beam and horse's head is shorter in duration than the downstroke, the accelerations and the decelerations of the walking beam and horse's head during the upstroke are larger than the accelerations and the deaccelerations encountered during the horse's head's downstroke. Because of this, the horse's head decelerates slowly as it nears the bottom of its stroke and then accelerates quickly upwards as it starts its upstroke and as the horse head approaches the top of its upstroke it decelerates quickly but, accelerates slowly downward at the start of its downstroke. It is believed that it is the combination of this slow deceleration and quick acceleration and quick deceleration and slow acceleration which causes a smoother movement of the walking beam than would be the motion of the walking beam if the acceleration and deceleration were equal.

Also the quick acceleration at the beginning of the horse's head upstroke results in improved pumping by means of allowing the piston at the bottom of the pump to pull quickly away from any sediment and provides quick movement of the fluid being pumped. And the slow deceleration at the end of the horse's head upstroke allows extra time for any oneway valves at the end of the pump to close before the start of the horse's head downstroke, providing more efficient pumping. In operation, the horse's head appears to pause at the top of its upstroke. This is believed to be a result of the previously described geometry.

The motion of the walking beam can be adjusted in the present invention by either changing the length of the pitman rod or changing the point at which the pitman pivot is affixed to the walking beam. The pitman rod comprises two shafts 40, 42 which are joined by a turnbuckle 44. Thus, the pitman rod length is adjusted by turning the turnbuckle to shorten or lengthen the pitman rod. Other methods of providing an adjustable length will be readily apparent to one skilled in the art. For example, a telescoping pitman rod could be provided.

Figure 5:
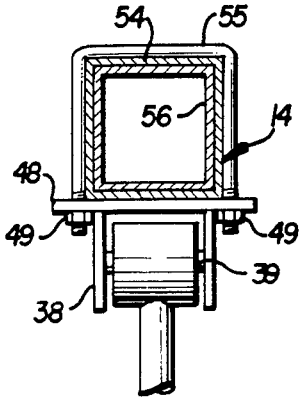
FIG. 5 is a sectional view taken along line 5—5 of FIG. 3.

The position of the pitman pivot on the walking beam is adjusted by means of a bracket 48 slidably mounted on the walking beam and on which the pitman pivot is mounted. The connection between the pitman pivot and walking beam is particularly shown in FIG. 5. The bracket has a plurality of lock nuts 49 which can be tightened on U-shaped clamps 55 to bind the bracket to the walking beam and prevent any sliding between the bracket and the walking beam. Other methods of holding the bracket known in the art, such as the use of a flanged walking beam having holes through which nut and bolt assemblies extend, would also be suitable.

A further adjustment for the pump jack is provided on the walking beam by providing for variation of the distance of the carriage 18 from the sampson pivot 20. This allows the balancing of the walking beam about the sampson pivot by adjusting the distance of the carriage mass from the sampson pivot. The carriage adjustment is provided by having the walking beam comprised in part of a rectangular hollow shaft 54 onto which is attached the horse's head and the sampson pivot and a smaller rectangular shaft 56 onto which the carriage is attached which slides inside the hollow rectangular shaft of the walking beam. Since the two shafts are slidably engaged the distance from the carriage to the sampson pivot can be adjusted by sliding the two shafts respective to each other. The two shafts are preferably secured with respect to each other by means of lock bolts 46 which extend through holes provided in both shafts. Especially on larger jacks, it may be desirable to counter balance the horse's head by means of larger weights directly loaded on a heavy duty walking beam. The weights could be made slidable relative to the beam to provide the versatility shown by the carriage and telescoping walking beam.

The speed reducer is resiliently mounted to the sampson post and pump jack so as to prevent any non-torsional forces from being transmitted from the crank center shaft into the speed reducer. The resilient mounting of the speed reducer is by means of a cantilevered spring 50 extending outwards from the casing of the speed reducer to the sampson post where it is ridgidly connected. Also, a torsion bar 52 is affixed to the speed reducer casing and the frame to prevent the speed reducer from rotating with the crank center shaft during operation of the pump jack. A torsion bar 51 is also provided, connecting the sampson post and the bottom section of the speed reducer. The input of the speed reducer is connected to a pulley 22. The pulley can be driven either by a belt drive or chain drive from either an internal combustion engine or an electric motor (not shown). The input of the speed reducer could also be directly coupled to the output of an engine or motor if desired. Other methods of supplying power to the pulley, such as a hydraulic system, would also be suitable.

Figure 6:
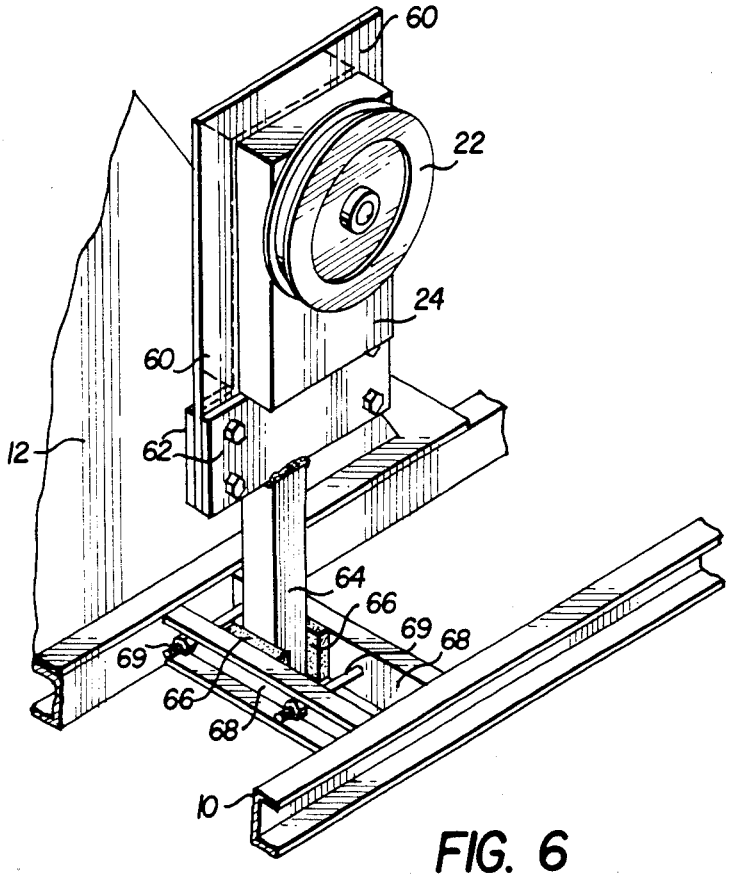
FIG. 6 is a partial view of another embodiment of the pump jack.

FIG. 6 shows another manner of connecting the speed reducer, mounted to the crank shaft as previously described, to the frame. Attached to the speed reducer 24 is a flange 60, extending at least partially around the periphery of the speed reducer. Two plates 62 straddle the flange at the bottom of the speed reducer, and form a type of U-shaped clamp around the flange. The plates may be bolted or welded together or other suitable connecting methods may be used, or they may be directly fastened to the flange. Attached to the plates, preferably by welding, is post 64. Post 64 is preferably force fitted, by means of elastic mounts 66, between members of the frame. The mounts 66 may be made from sections of tire tread. In the embodiment shown, two C-channels 68, placed back to back accomplish this purpose. Bolts 69 may be used to provide pressure to maintain the force fit.

By mounting the crank center shaft onto the sampson center post and by resiliently mounting the speed reducer onto the pump jack, the only forces transmitted through the speed reducer are those torsional forces from the pulley which drive the speed reducer and the crank center shaft. With only torsional forces operating on the speed reducer, the speed reducer can be relatively small, and the horsepower requirement of the pump jack is much smaller than would be required of a pump jack which has a much larger speed reducer. The much larger speed reducer would be necessary because of the large forces acting on the speed reducer because of the crank center shaft being supported solely by the speed reducer.

Below is a table comparing characteristics of the pump jack of the present invention with a commonly used commercial jack, the Churchhill Model 4M-10-32-20.

| Characteristic | Present Invention | Prior Art |
|---|---|---|
| Beam capacity (maximum weight suspended from nose) | 6000 lb | 3200 lb |
| Stroke length (maximum) | 21 inches | 20 inches |
| Engine power (minimum necessary) | 1.5 HP electric or 2.0 HP gasoline | 3 HP electric or 8 HP gasoline |
| Gearbox torque (minimum) | 5380 inch-pounds | 10,000 inch-pounds |
| Gearbox cost | $450.00 | $2300.00 |

What is claimed:

1. A pump jack comprising:

a frame;

a sampson post structure mounted on said frame;

a walking beam pivotally connected to said sampson post structure via a sampson pivot;

a crank bearing securely mounted to said sampson post structure;

a crank rotatably coupled to said crank bearing;

a speed reducer non-rotatably coupled to said crank and laterally displaced with respect to said walking beam;

a metal post securely fastened to said speed reducer and extending substantially vertically to said frame;

elastic mounts secured to said frame for receiving said metal post;

driving means connected to said speed reducer to rotate said crank;

and a pitman rod rotatably connected at one end to said crank and connected at the opposite end to said walking beam via a pitman pivot.

2. A pump jack comprising:

a frame;

a sampson post structure mounted on said frame;

a walking beam fixedly and pivotally connected to said sampson post structure via a sampson pivot;

a horse's head connected to one end of said walking beam;

a counter weight attached to the other end of said walking beam;

a plurality of crank bearings securely mounted to said sampson post;

a crank rotatably coupled to said crank bearings;

a speed reducer, having a first face disposed to face toward said sampson post structure and a second face located opposite said first face and disposed to face away from said sampson post structure, non-rotatably coupled to said crank, and laterally displaced with respect to said walking beam;

a flange extending outwardly from the periphery of said speed reducer;

a metal post of rectangular cross section extending substantially vertically downwardly from said flange and from a position at the bottom of said speed reducer;

a pair of opposed elastic mounts located between cross members of said frame, for receiving said metal post, said metal post being force-fitted between said elastic mounts;

driving means connected to said speed reducer to rotate said crank; and a single pitman rod rotatably connected at one end to said crank and connected at the other end to said walking beam via a pitman pivot, the horizontal distance from said sampson pivot to said pitman pivot being greater than the horizontal distance from said sampson pivot to said crank bearings.

* * * * *